US007360992B2

(12) United States Patent
Cho

(10) Patent No.: US 7,360,992 B2
(45) Date of Patent: Apr. 22, 2008

(54) FAN TO GENERATE AIR FLOW IN AXIAL AND RADIAL DIRECTIONS

(75) Inventor: Jin-hyun Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/300,342

(22) Filed: Dec. 15, 2005

(65) Prior Publication Data

US 2006/0269406 A1 Nov. 30, 2006

(30) Foreign Application Priority Data

May 27, 2005 (KR) ..... 10-2005-0045116

(51) Int. Cl.
*F04B 17/00* (2006.01)

(52) U.S. Cl. ..... 415/220; 165/122

(58) Field of Classification Search ..... 415/220, 415/206, 203; 165/122
See application file for complete search history.

(56) References Cited

U.S. PATENT DOCUMENTS

| | | | | |
|---|---|---|---|---|
| 6,457,955 | B1 * | 10/2002 | Cheng | 417/423.8 |
| 6,902,377 | B2 * | 6/2005 | Crocker | 416/223 R |
| 7,051,791 | B2 * | 5/2006 | Hashimoto et al. | 165/80.3 |
| 2004/0208746 | A1 | 10/2004 | Crocker | |
| 2005/0056405 | A1 | 3/2005 | Hashimoto et al. | |

FOREIGN PATENT DOCUMENTS

| | | |
|---|---|---|
| JP | 2-214456 | 8/1990 |
| JP | 2-231940 | 9/1990 |
| JP | 8289504 | 11/1996 |
| JP | 3080194 | 6/2001 |
| KR | 2001-27972 | 4/2001 |
| KR | 2004-50378 | 6/2004 |
| KR | 2005-27937 | 3/2005 |

OTHER PUBLICATIONS

Korea Office Action dated Jun. 29, 2006 issued in KR 2005-45116.
Chinese Office Action dated Dec. 21, 2007 issued in CN 2006100827560.

* cited by examiner

*Primary Examiner*—Edward K. Look
*Assistant Examiner*—Dwayne J White
(74) *Attorney, Agent, or Firm*—Stanzione & Kim, LLP

(57) ABSTRACT

A fan including a driving motor, a plurality of blades which are connected to the driving motor to rotate, and a housing having a housing main body to accommodate the driving motor and the blades, an air inhaler that is provided in the housing main body to inhale air toward the plurality of blades, an axial air discharger that is provided in a rotational axis direction of the plurality of blades and a radial air discharger that is provided in a radial direction substantially perpendicular to the rotational axis. The fan generates air flow both in the axial and radial directions, thereby increasing the number of directions in which air flows, reducing the number of fans to be used, minimizing an installation space required, and reducing noise generated by the fans.

20 Claims, 4 Drawing Sheets

FAN TO GENERATE AIR FLOW IN AXIAL AND RADIAL DIRECTIONS

CROSS-REFERENCE TO RELATED APPLICATIONS

This application claims the benefit under 35 U.S.C. § 119 of Korean Patent Application No. 2005-45116, filed on May 27, 2005, in the Korean Intellectual Property Office, the disclosure of which is incorporated herein in its entirety.

BACKGROUND OF THE INVENTION

1. Field of the Invention

The present general inventive concept relates to a fan, and more particularly, to a fan that generates an air flow both in axial and radial directions.

2. Description of the Related Art

Generally, various fans that forcibly ventilate air are used to cool off heat generated from home electronic appliances, such as an air conditioner, a ventilation system and other various electronic appliances.

The fans are classified into axial type fans and radial type fans according to a direction of an air flow generated by the fans. The axial type fans direct the air flow in parallel with a rotational axis, and generate a vast amount of air flow with low pressure. In contrast, the radial type fans direct the air flow generated from an inlet of blades in a direction of the rotational axis, and direct the air flow from an outlet thereof in a radial direction perpendicular to the rotational axis, thereby generating a small amount of air flow with high pressure.

Accordingly, fans are selected to cool heat generated by various apparatuses based on characteristics of the fans. For example, an electronic appliance, such as an LCD TV, collects heat generated from various heat sources (e.g., a display panel, a panel driver, etc.) to a heat sink and forcibly ventilates air through a fan to dissipate the collected heat. If a fan is to be disposed in an upper portion of the heat sink, the axial type fan is selected to be mounted in the electronic appliance. If a fan is to be disposed in a lateral portion of the heat sink, the radial type fan is selected to be mounted therein. In some cases, both the axial type fan and the radial type fan may be mounted in the electronic appliance at the same time as necessary.

However, if using both the axial type fan and the radial type fan, the two fans require a large installation space while noise increases as the two fans are mounted in same apparatus.

SUMMARY OF THE INVENTION

The present general inventive concept provides a fan that generates air flow both in axial and radial directions, thereby reducing the number of fans to be used for cooling, minimizing an installation space required, and reducing noise generated therefrom.

Additional aspects of the present general inventive concept will be set forth in part in the description which follows and, in part, will be obvious from the description, or may be learned by practice of the present general inventive concept.

The foregoing and/or other aspects and utilities of the present general inventive concept are achieved by providing a fan comprising a driving motor, a plurality of blades connected to the driving motor to rotate and generate an air flow, and a housing having a housing main body to accommodate the driving motor and the plurality of blades, an air inhaler provided in the housing main body to inhale air toward the plurality of blades, an axial air discharger provided in a rotational axis direction of the plurality of blades and a radial air discharger provided in a radial direction substantially perpendicular to the rotational axis direction.

The housing main body may comprise an accommodator shaped like a cylinder to accommodate the driving motor and the plurality of blades, and the radial air discharger can be formed on an open portion of an inner peripheral surface of the accommodator open.

The inner peripheral surface of the accommodator may be provided with an inclination part to enlarge an air discharging area toward the axial air discharger.

The fan may further comprise a hub shaped like a cylinder and coupled to the driving motor to rotate the plurality of blades that are formed along an outer peripheral surface of the hub to extend in radial directions.

The plurality of blades may be twisted to form a predetermined wing angle in the outer peripheral surface of the hub.

The foregoing and/or other aspects of the present general inventive concept are also achieved by providing a fan to generate an air flow, the fan including a housing, an air inhaler opening formed in a first side of the housing to inhale air therein, an axial air discharger opening formed in a second side of the housing substantially opposite to the first side to discharge the inhaled air from the housing, and a radial air discharger formed in at least one side of the housing and adjacent to the first and second sides to discharge the inhaled air from the housing in a direction other than the second side.

The foregoing and/or other aspects of the present general inventive concept are also achieved by providing a fan including a driving motor to rotate around an axis, an accommodating surface that is cylindrical and surrounds the driving motor around the axis at less than 360°, a plurality of blades each connected to the driving motor and extending towards the accommodating surface in directions substantially perpendicular to the axis, and when the plurality of blades rotate with the driving motor, the plurality of blades direct air in the axial direction and through a portion of the accommodating surface that is missing from the 360° surrounding the driving motor.

The foregoing and/or other aspects of the present general inventive concept are also achieved by providing an apparatus comprising a fan including a housing, an air inhaler opening formed on a first side of the housing to inhale air therein, an axial air discharger opening formed on a second side of the housing substantially opposite to the first side to discharge the inhaled air from the housing, and a radial air discharger to discharge the inhaled air from the housing in one or more directions towards lateral sides of the housing other than the first side and the second side.

The foregoing and/or other aspects of the present general inventive concept are also achieved by providing a display apparatus including at least one heat sink to absorb heat generated by components of the display apparatus, and at least one fan to dissipate the heat absorbed by a respective one of the at least one heat sink and to cool a display part, the at least one fan comprising a housing, an air inhaler opening formed on a first side of the housing to inhale air therein, an axial air discharger opening formed on a second side of the housing substantially opposite to the first side to discharge the inhaled air from the housing, the air discharged from the housing being directed towards the respective at least one heat sink, and a radial air discharger to discharge the inhaled air from the housing towards the display part.

The foregoing and/or other aspects of the present general inventive concept are also achieved by providing a cooling unit including a housing comprising an air inhaler part to inhale air, a first air discharger to discharge the inhaled air out of the housing in a first direction, and a second air discharger to discharge the inhaled air out of the housing in a second direction substantially perpendicular to the first direction.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
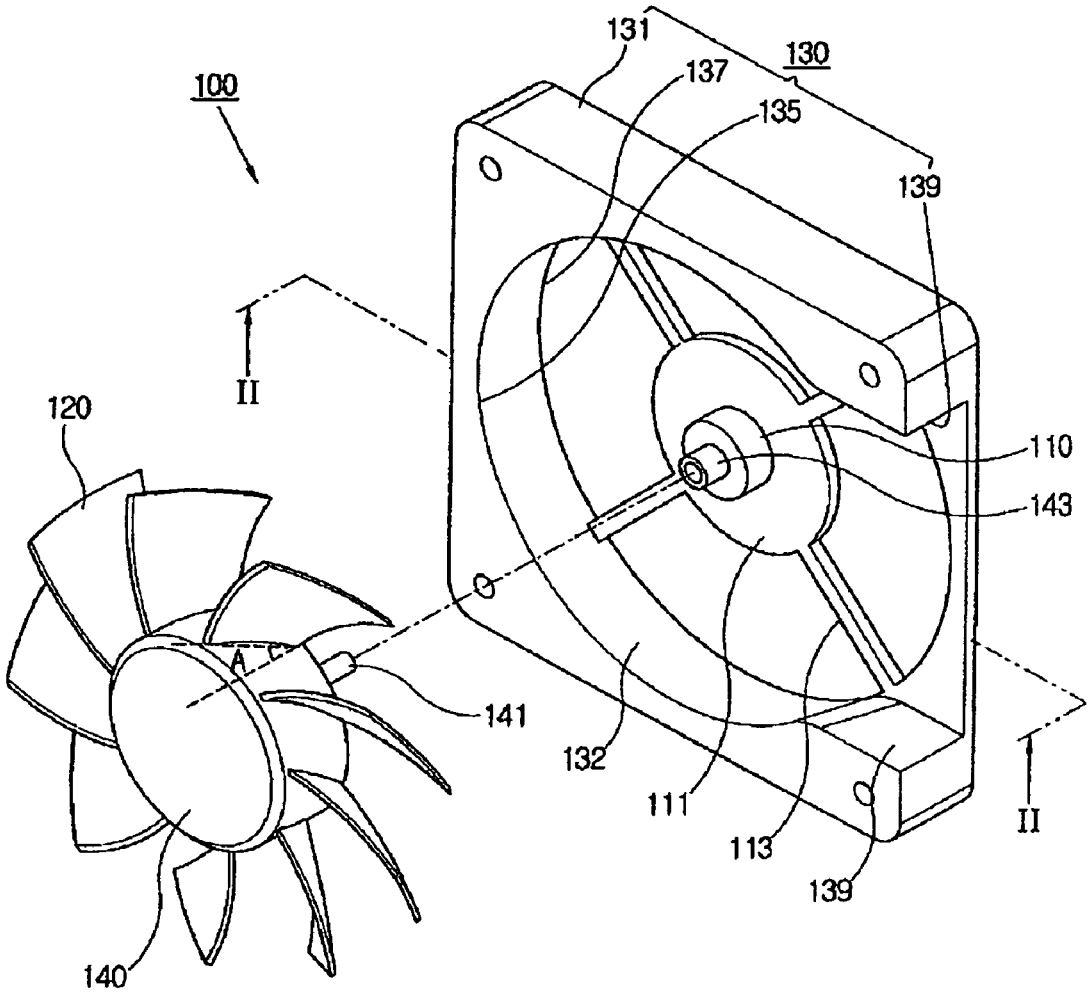
FIG. 1 is an exploded perspective view of a fan according to an embodiment the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
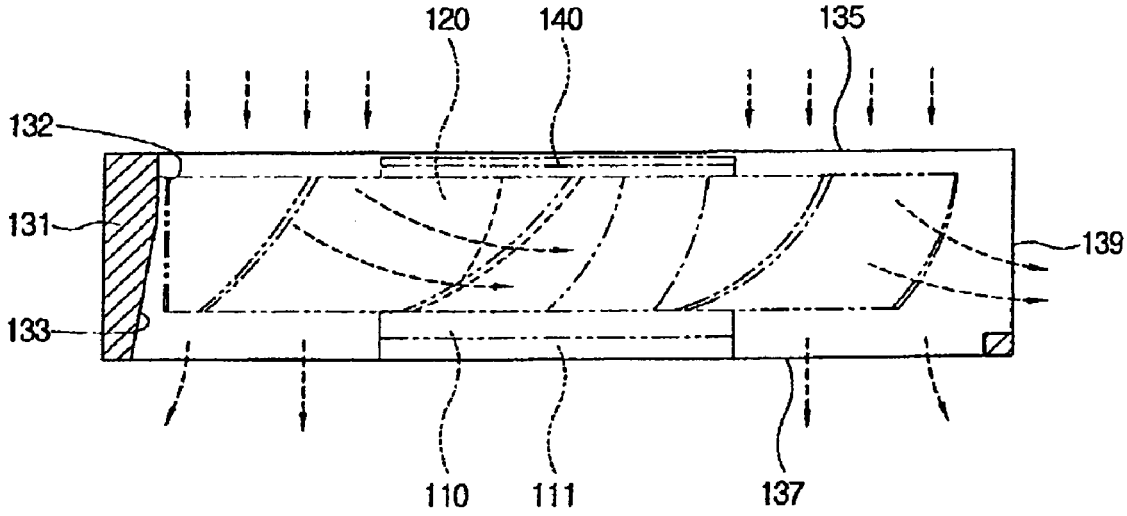
FIG. 2 illustrates air flow of the fan of FIG. 1, taken along a line II-II in FIG. 1.

As illustrated in FIGS. 1 and 2, a fan 100 according to an embodiment of the present general inventive concept comprises a driving motor 110, a plurality of blades 120 that are connected to the driving motor 110 to rotate therewith and create an air flow, a housing 130 having a housing main body 131 to accommodate the driving motor 110 and the blades 120, an air inhaler 135 which is provided in the housing main body 131 to inhale air toward the blades 120, an axial air discharger 137 which is provided in a direction of a rotational axis (axial direction) of the blades 120, and a radial air discharger 139 which is provided on a side of the housing main body 131.

The driving motor 110 is accommodated in the housing main body 131 and coupled to a hub 140 to transmit a driving force thereto. A driving motor support 111 may be provided in the housing 130 to support the driving motor 110. As illustrated in FIG. 1, the driving motor support 111 may be attached to the housing main body 131 by a plurality of ribs 113 that extend from the driving motor support 111 to an inner peripheral surface of an accommodator 132 of the housing main body 131. Here, the driving motor 110 may be a DC motor, but the present general inventive concept is not intended to be limited thereto, and other types of motors may be used as an alternative.

The hub 140 is coupled to the driving motor 110 to receive a rotational force therefrom and rotate. The hub 140 may be shaped like a cylinder, but the present general inventive concept is not intended to be limited thereto. A shaft protrusion 141 is formed in a center of the hub 140 and points toward the driving motor 110 to be coupled to a shaft accommodator 143 provided at the driving motor 110. Alternatively, the shaft protrusion 141 may be formed at the driving motor 110, and the shaft accommodator 143 may be formed at the center of the hub 140 to couple with the shaft protrusion 141.

The blades 120 are formed on an outer peripheral surface of the hub 140 and extend in a radial direction of the hub 140. The blades 120 may integrally extend from the outer peripheral surface of the hub 140, or may be manufactured separately and coupled to the hub 140. If multiple blades 120 are provided, the blades 120 may be spaced at the same interval from each other around the hub 140. There is no limitation to the number of the blades 120 that can be provided. Further, the number of blades 120 may be either odd or even.

For example, as illustrated in FIG. 1, the blades 120 may be mounted at a diagonal angle with respect to the axial direction of the hub 140 to generate an air flow in both the axial and radial directions. The air flow in the axial direction is referred to as the axial air flow and the air flow in a radial direction is referred to as the radial air flow. That is, the blades 120 may be twisted to form a predetermined wing angle "A" with respect to the rotational axis (axial direction). The wing angle "A" influences a ratio of the radial air flow to the axial air flow as the blades 120 disperse air inhaled through the air inhaler 135 to the axial air discharger 137 and the radial air discharger 139. That is, as the wing angle "A" becomes smaller, (i.e., the angle between the rotational axis and the blades 120 becomes smaller) the amount of the air discharged through the radial air discharger 139 becomes lager than that discharged through the axial air discharger 137. The ratio of the axial air flow to the radial air flow may be adjusted by changing the wing angle "A". For example, the ratio of the axial air flow to the radial air flow may be adjusted to 1:1.

The housing 130 accommodates the driving motor 110 and the blades 120. The housing 130 comprises the housing main body 131 having the accommodator 132 which is shaped like a cylinder and accommodates the driving motor 110, the blades 120, and an inclination part 133. The air inhaler 135, the axial air discharger 137 and the radial air discharger 139 are also provided in the housing main body 131.

The accommodator 132 is shaped like a cylinder, and accommodates the driving motor 110 and the blades 120. The driving motor 110 is supported by the driving motor support 111. The driving motor support 111 is supported by the plurality of ribs 113 that extend from the driving motor support 111 to the inner peripheral surface of the accommodator 132. The accommodator 132 may have various shapes as long as it does not interfere with the rotation of the blades 120. As illustrated in FIG. 2, the accommodator 132 may comprise the inclination part 133 that is outwardly inclined to enlarge a discharging area toward a discharging end of the axial air discharger 137. The inclination part 133 allows the air forcibly ventilated by the blades 120 to blow toward a larger area.

The air inhaler 135 is provided in the housing main body 131 to inhale external air toward the blades 120. As illustrated in FIG. 1, the air inhaler 135 may be formed in a direction of the rotational axis of the blades 120. Also, the air inhaler 135 may be provided in any position as long as it inhales the external air to the blades 120. The axial air discharger 137 is formed in a direction of the rotational axis of the blades 120 to allow the air forcibly ventilated by the blades 120 to be discharged to the axial direction. As illustrated in FIG. 1, the air inhaler 135 and the axial air discharger 137 may face each other on the rotational axis, but the present general inventive concept is not intended to be limited thereto.

Figure 4:
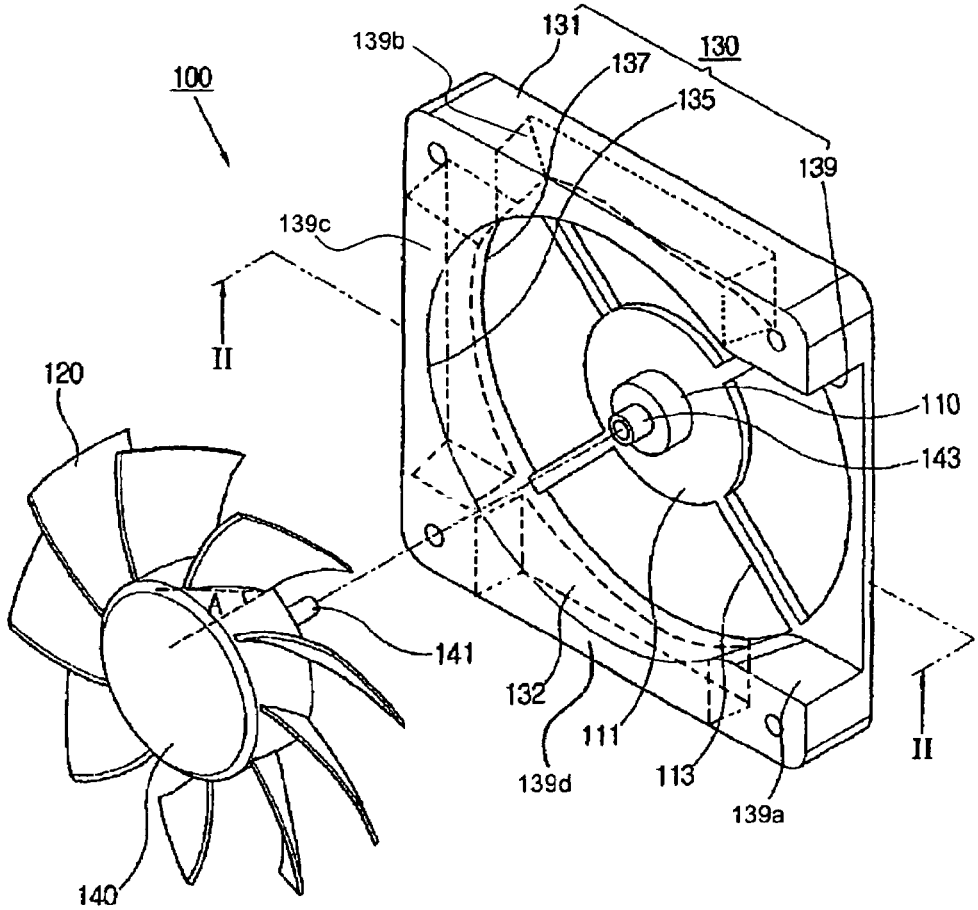
FIG. 4 is an exploded perspective view of a fan according to another embodiment the present general inventive concept.

The radial air discharger 139 is formed in a radial direction of the rotational axis, and one side of the inner peripheral surface of the accommodator 132 is open. As illustrated in FIG. 1, a quarter of the inner peripheral surface of the accommodator 132 may be open to accommodate the radial air discharger 139. Alternatively, a larger or smaller portion of the inner peripheral surface of the accommodator 132 may be open to accommodate the radial air discharger 139. Additionally, a plurality of portions of the inner peripheral surface of the accommodator 132 may be open to accommodate the radial air discharger 139. When discharging the radial air flow generated by the fan 100 in a plurality of radial directions, the housing main body 131 may be open at areas corresponding to the respective radial directions to provide a plurality of radial air dischargers 139*a* through 139*d*, as illustrated in FIG. 4. An overall size of the open radial air discharger 139 influences the amount of the radial air flow.

Hereinbelow, a process of operating the fan 100 and an embodiment thereof will be described in detail.

Referring to FIG. 2, the housing main body 131 according to an embodiment of the present general inventive concept accommodates the driving motor 110 and the blades 120. If an external power is supplied to the driving motor 110, the driving motor 110 is driven and the hub 140 that is connected with the driving motor 110 rotates, thereby rotating the blades 120. At this time, the blades 120 rotate in a clockwise manner. With reference to the positioning of the housing main body 131, the air inhaler 135 is provided at an upper part of the housing main body 131, and the axial air discharger 137 is disposed at a lower part thereof. Thus, the radial air discharger 139 is formed in a rightward direction of the housing main body 131. If the blades 120 rotate, the air surrounding the blades 120 is forcibly discharged, thereby inhaling the external air through the air inhaler 135 due to a pressure difference between upper and lower parts of the blades 120 (where a lower part of a blade is closer to the hub 140 and an upper part of the blade is further away from the hub 140). The inhaled air moves along the upper and lower parts of the blades 120. A part of the air flow is discharged to the axial air discharger 137, and another part of the air flow is discharged to the radial air discharger 139. The wing angle "A" of the blades 120 may be adjusted to change the ratio of the axial air flow to the radial air flow. The air discharged to the axial air discharger 137 is extended toward the radial directions of the accommodator 132 also due to the inclination part 133 provided at the discharging end of the housing main body 131.

Figure 3:
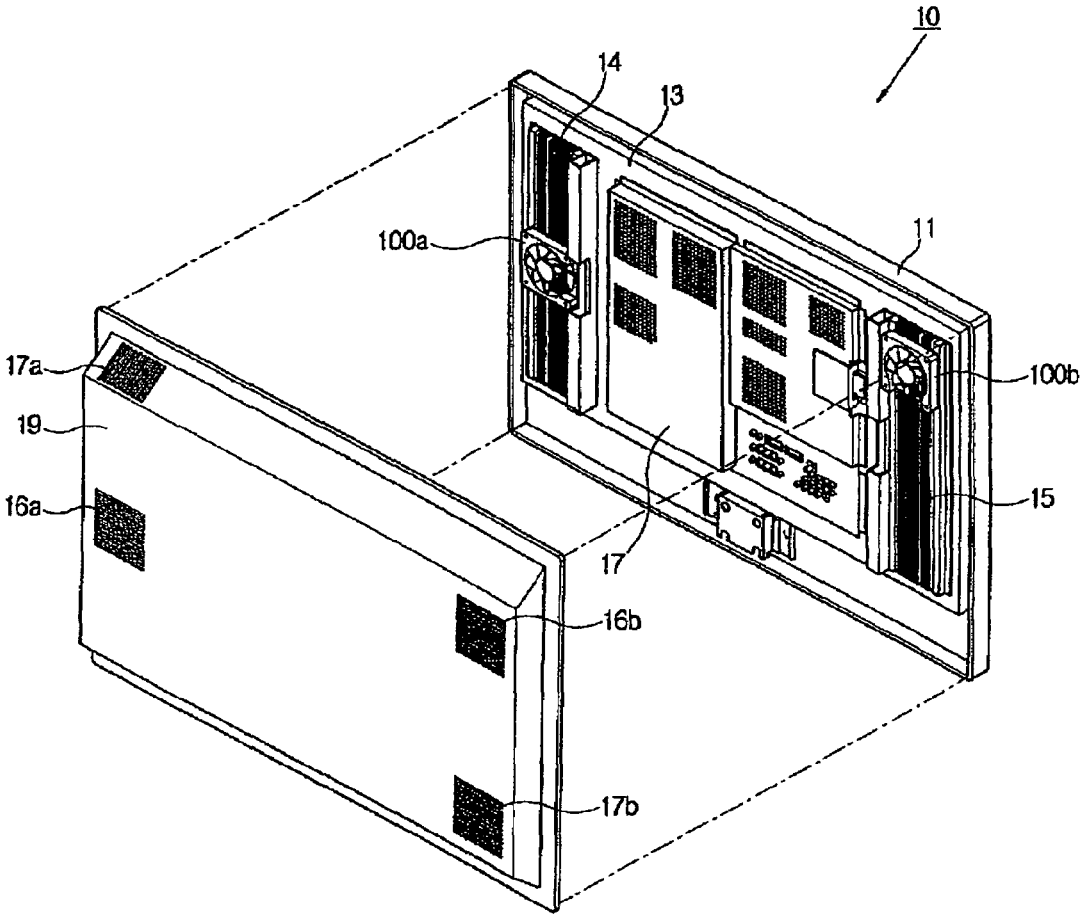
FIG. 3 is a perspective view of a display apparatus including a fan according to an embodiment the present general inventive concept.

FIG. 3 is a perspective view of a display apparatus including a fan according to an embodiment of the present general inventive concept. In FIG. 3, the display apparatus 10 is viewed from a rear side thereof. Referring to FIG. 3, the display apparatus 10, such as a liquid crystal display (LCD) television (TV), comprises a main body frame 11, a display part 13 that is supported by the main body frame 11 and displays an image thereon, a display driver 17 to drive the display part 13, and a rear cover 19. A plurality of heat sources, such as an LED light source or the display driver 17, are provided in the display apparatus 10. The heat generated from the heat sources is drawn to a first heat sink 14 and a second heat sink 15 through a predetermined heat transfer member (not shown).

The first and second heat sinks 14 and 15 may be provided at different positions and may have various sizes according to a size of the display apparatus 10 or an amount of heat that has to be discharged. For example, there may be provided two heat sinks on opposite sides of the main body frame 11 and each shaped like a rectangle.

Referring to a ventilation process of a fan 100*a* provided at the first heat sink 14, air inhaled through an inhale hole 16*a* (provided in the rear cover 19) passes through the fan 100*a*, and a part of an air flow generated by the fan 100*a* is supplied to the heat sink 14 through the axial air discharger 137, and a remaining part of the air flow is supplied to the display driver 17 through the radial air discharger 139. The air that is heated while passing through the heat sink 14 and the display driver 17 is discharged to the outside through discharging holes 17*a* and 17*b* that are provided in the rear cover 19.

Meanwhile, referring to a ventilation process of a fan 100*b* provided in the second heat sink 15, air inhaled through an inhale hole 16*b* (provided at the rear cover 19) passes through the fan 100*b*, and a part of an air flow generated by the fan 100*b* is directly supplied to the heat sink 15 through the axial air discharger 137, and a remaining part of the air flow passes through the heat sink 15 to be supplied to the discharging hole 17*b* disposed in the lower part of the rear cover 19. Accordingly, the air that is heated passing through the heat sink 15 may be discharged to the outside, instead of continuously circulating within the inside of the display apparatus 10.

The axial air discharger 137 and the radial air discharger 139 (see FIGS. 1 and 2) may be disposed in the fan 100 corresponding to different positions receiving the air flow. If using a conventional fan, an axial fan directed to the first heat sink 14 and a radial fan directed to the display driver 17 should be provided in the first heat sink 14. Therefore, the fan 100 according to various exemplary embodiments of the present general inventive concept reduces the number of required fans by half, minimizes an installation space required, and reduces noise.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fan, comprising:

a driving motor;

a plurality of blades extending from a central hub to rotate and generate an air flow in both axial and radial directions; and a housing having a housing main body to accommodate the driving motor and the plurality of blades, an air inhaler provided in the housing main body to inhale air toward the plurality of blades, an axial air discharger provided along a rotational axis direction of the plurality of blades and a radial air discharger provided in a radial direction substantially perpendicular to the rotational axis direction.

2. The fan according to claim 1, wherein the housing main body comprises:

an accommodator shaped like a cylinder to accommodate the driving motor and the plurality of blades, and the radial air discharger is formed on an open portion of an inner peripheral surface of the accommodator.

3. The fan according to claim 2, wherein the inner peripheral surface of the accommodator is provided with an inclination part that tapers outwardly toward the axial air discharger.

4. The fan according to claim 1, wherein the central hub is shaped like a cylinder and coupled to the driving motor to rotate the plurality of blades, which are formed along an outer peripheral surface of the central hub and extending in radial directions with respect to the central hub.

5. The fan according to claim 4, wherein the plurality of blades are twisted at the outer peripheral surface of the central hub to form a predetermined wing angle with respect to the radial direction.

6. A fan, comprising:

a housing;

an air inhaler opening formed in a first side of the housing to inhale air therein;

an axial air discharger opening formed in a second side of the housing substantially opposite to the first side to discharge the inhaled air from the housing;

a radial air discharger formed in at least one side of the housing and adjacent to the first and second sides to discharge the inhaled air from the housing in a direction other than the second side; and a plurality of blades extending from a rotation axis to generate an air flow in both axial and radial directions, and connected to the driving motor, wherein each of the plurality of blades extends in a radial direction perpendicular to the rotation axis and is twisted to form a wing angle.

7. The fan according to claim 6, wherein a ratio between an amount of air discharged through the axial air discharger, and an amount of air discharged through the radial air discharger at a same time is changed by modifying the wing angle of each of the plurality of blades.

8. The fan according to claim 6, further comprising:

a driving motor disposed inside the housing to rotate around the rotation axis; and a hub to connect the plurality of blades to a shaft of the driving motor, wherein each of the plurality of blades extends radially from an outer surface of the hub.

9. The fan according to claim 8, wherein the hub and the plurality of blades are formed integrally.

10. The fan according to claim 8, wherein:

the driving motor includes a shaft protrusion, and the hub includes a shaft accomodator to engage with the shaft protrusion.

11. The fan according to claim 8, wherein:

the driving motor includes a shaft accommodator, and the hub includes a shaft protrusion to engage with the shaft accomodator.

12. The fan according to claim 6, wherein the housing accommodates a plurality of radial air dischargers formed in one or more sides of the housing adjacent to the first and second sides.

13. The fan according to claim 6, wherein the housing comprises an accommodator disposed at an interior surface of the housing between and connecting the air inhaler opening to the axial air discharger opening at all locations between the air inhaler opening and the axial air discharger opening except at the at least one side of the housing where the radial air discharger is formed.

14. The fan according to claim 13, wherein the accommodator includes an inclined surface to enlarge an area of the axial air discharger opening in a direction in which the inhaled air is discharged.

15. A fan, comprising:

a driving motor to rotate around an axis;

an accommodating surface that is cylindrical and surrounds the driving motor around the axis at less than 360°;

a plurality of blades each connected to the driving motor and extending towards the accommodating surface in directions substantially perpendicular to the axis, and when the plurality of blades rotate with the driving motor, the plurality of blades direct air in the axial direction and through a portion of the accommodating surface that is missing from the 360° surrounding the driving motor.

16. An apparatus, comprising:

a fan comprising:

a housing, an air inhaler opening formed on a first side of the housing to inhale air therein, an axial air discharger opening formed on a second side of the housing substantially opposite to the first side to discharge the inhaled air from the housing, a radial air discharger to discharge the inhaled air from the housing in one or more directions towards lateral sides of the housing other than the first side and the second side, and a plurality of blades extending from a central hub to generate an air flow in both axial and radial directions corresponding to the axial air discharger and the radial air discharger, respectively.

17. A display apparatus, comprising:

at least one heat sink to absorb heat generated by components of the display apparatus; and at least one fan to dissipate the heat absorbed by a respective one of the at least one heat sink and to cool a display part, the at least one fan comprising:

a housing, an air inhaler opening formed on a first side of the housing to inhale air therein, an axial air discharger opening formed on a second side of the housing substantially opposite to the first side to discharge the inhaled air from the housing, the air discharged from the housing being directed towards the respective at least one heat sink, a radial air discharger to discharge the inhaled air from the housing towards the display part, and a plurality of blades extending from a central hub to generate an air flow in both axial and radial directions corresponding to the axial air discharger and the radial air discharger, respectively.

18. A cooling unit, comprising:

a housing comprising:

an air inhaler part to inhale air;

a first air discharger to discharge the inhaled air out of the housing in a first direction;

a second air discharger to discharge the inhaled air out of the housing in a second direction substantially perpendicular to the first direction; and a plurality of blades extending from a rotation axis to generate an air flow in both the first and second directions corresponding to the first air discharger and the second air discharger, respectively, wherein each of the plurality of blades extends in a radial direction perpendicular to the rotation axis and is twisted to form a wing angle.

19. A fan, comprising:

a plurality of blades having a same shape to generate an air flow in both an axial and a radial direction with respect to a rotating direction of the blades;

a housing having an air intake to supply air to the plurality of blades, a plurality of first air dischargers to discharge air in the axial direction, and a plurality of second air discharges to discharge air in the radial direction.

20. The fan of claim 19, wherein the ratio of air discharged in the radial direction to the axial direction is controlled by the wing angle of the plurality of blades.

* * * * *